US010231896B2

(12) United States Patent
Younger

(10) Patent No.: US 10,231,896 B2
(45) Date of Patent: Mar. 19, 2019

(54) CRUTCH

(71) Applicant: MOBILITY DESIGNED, LLC, Kansas City, MO (US)

(72) Inventor: Max Jefferies Younger, Roeland Park, KS (US)

(73) Assignee: MOBILITY DESIGNED, INC., Kansas City, MO (US)

( * ) Notice: Subject to any disclaimer, the term of this patent is extended or adjusted under 35 U.S.C. 154(b) by 0 days.

(21) Appl. No.: 15/089,048

(22) Filed: Apr. 1, 2016

(65) Prior Publication Data

US 2016/0287464 A1 Oct. 6, 2016

Related U.S. Application Data

(60) Provisional application No. 62/253,789, filed on Nov. 11, 2015, provisional application No. 62/142,235, filed on Apr. 2, 2015.

(51) Int. Cl.
*A61H 3/02* (2006.01)
*A45B 9/02* (2006.01)
(Continued)

(52) U.S. Cl.
CPC ..... *A61H 3/02* (2013.01); *A45B 7/005* (2013.01); *A45B 9/02* (2013.01); *A45B 9/04* (2013.01); *A45B 2009/007* (2013.01); *A61H 3/0288* (2013.01); *A61H 3/04* (2013.01); *A61H 2003/006* (2013.01); *A61H 2003/007* (2013.01); *A61H 2003/0205* (2013.01); *A61H 2003/025* (2013.01); *A61H 2003/0216* (2013.01);
(Continued)

(58) Field of Classification Search
CPC ..... A61H 3/02; A61H 2203/006; A61H 2003/0227; A61H 2003/0238
See application file for complete search history.

(56) References Cited

U.S. PATENT DOCUMENTS 3,947,140 A 3/1976 Thomas
D258,096 S * 2/1981 Barfod ..... D3/8
(Continued)

FOREIGN PATENT DOCUMENTS

ES 2431414 A1 11/2013
ES 1216611 U 8/2018
(Continued)

OTHER PUBLICATIONS

PCT Application No. PCT/US2016/025684, International Search Report dated Jul. 18, 2016, two pages.
(Continued)

*Primary Examiner* — David R Dunn
*Assistant Examiner* — Danielle Jackson
(74) *Attorney, Agent, or Firm* — Lathrop Gage L.L.P.

(57) ABSTRACT

Embodiments of crutches are disclosed. A crutch has a main body having a substantially vertical tubular member with a plurality of apertures formed therein; an angled portion extending upwardly from the substantially vertical tubular member; an arm rest support extending perpendicularly from the angled portion for receiving an arm rest; and a handle extending outwardly from the arm rest support. The crutch further includes a leg telescopically received into the substantially vertical tubular member, and a foot exchangably received by the leg.

18 Claims, 11 Drawing Sheets

(51) Int. Cl.

| | |
|---|---|
| *A45B 9/00* | (2006.01) |
| *A61H 3/00* | (2006.01) |
| *A45B 7/00* | (2006.01) |
| *A45B 9/04* | (2006.01) |
| *A61H 3/04* | (2006.01) |

(52) U.S. Cl.

CPC ..... *A61H 2201/0192* (2013.01); *A61H 2201/1697* (2013.01); *A61H 2201/5097* (2013.01); *A61H 2230/06* (2013.01); *A61H 2230/30* (2013.01); *A61H 2230/80* (2013.01)

(56) References Cited

U.S. PATENT DOCUMENTS

| | | | | |
|---|---|---|---|---|
| 4,708,154 | A | 11/1987 | Edwards | |
| 5,301,704 | A * | 4/1994 | Brown | A45B 9/04 135/78 |
| 5,329,954 | A | 7/1994 | Miyoshi | |
| 5,499,645 | A * | 3/1996 | Baliga | A61H 3/00 135/67 |
| 5,564,451 | A | 10/1996 | Hagberg | |
| 5,671,765 | A * | 9/1997 | Hagberg, Jr. | A61H 3/02 135/68 |
| 7,494,138 | B2 * | 2/2009 | Graham | A61G 5/08 280/304.5 |
| 7,621,288 | B2 | 11/2009 | Evans | |
| 8,418,706 | B2 * | 4/2013 | Weber | A61H 3/02 135/66 |
| 8,474,470 | B2 * | 7/2013 | Albertyn | A61H 3/02 135/69 |
| 9,032,982 | B2 * | 5/2015 | Summit | A61H 3/02 135/68 |
| 9,289,347 | B2 * | 3/2016 | Powell | A61H 3/04 |
| 9,532,917 | B2 * | 1/2017 | Summit | A61F 5/013 |
| 9,585,807 | B2 * | 3/2017 | Fellingham | A61H 3/04 |
| 2004/0020525 | A1 | 2/2004 | Lev | |
| 2011/0108075 | A1 | 5/2011 | Weber | |
| 2012/0053018 | A1 | 3/2012 | Kaupe | |
| 2014/0196757 | A1 * | 7/2014 | Goffer | A61H 3/02 135/66 |
| 2014/0261594 | A1 * | 9/2014 | Salomon | A45B 1/02 135/85 |
| 2014/0265256 | A1 * | 9/2014 | Rothstein | A61H 3/04 280/651 |
| 2016/0151229 | A1 * | 6/2016 | Varghese | A61H 3/02 135/71 |

FOREIGN PATENT DOCUMENTS

| | | | |
|---|---|---|---|
| JP | 03292956 | A | 12/1991 |
| WO | 2010017566 | A2 | 2/2010 |
| WO | 2014210495 | A1 | 12/2014 |

OTHER PUBLICATIONS

European Application No. 16774360.8, Extended European Search Report, dated Oct. 10, 2018, 12 pages.

* cited by examiner

CRUTCH

RELATED APPLICATIONS

This application claims priority to U.S. Provisional Application No. 62/142,235, filed on Apr. 2, 2015, and U.S. Provisional Application No. 62/253,789, filed Nov. 11, 2015. The disclosures of each are incorporated by reference in their entireties herein.

BACKGROUND

The crutch is a mobility aid that is widely used throughout the world. Crutches allow the user to support their body weight in the event that the lower extremities of the body are unable to do so. Typically, a crutch is provided for each side of the body, and often are configured to fit beneath the under arms of the user. Handles are located on the crutches, and the user such that, in use, the person's weight is distributed between the under arms, the hands, and the wrists of the user.

There are several disadvantages to traditional crutches. Many people have difficulty coordinating movement with crutches due to the uncomfortable positioning of the crutches at the underarms. Further, the user may quickly become fatigued, and the stress placed on the user's hands and wrists may perpetuate further injury. It would be desirable to have a crutch that allows for an easier transition for the user and that allows the user to make use of his or her elbows and/or upper arms to support the body weight.

SUMMARY

The following presents a simplified summary of the invention in order to provide a basic understanding of some aspects of the invention. This summary is not an extensive overview of the invention. It is not intended to identify critical elements of the invention or to limit the scope of the invention. Its sole purpose is to present some concepts of the invention in a simplified form as a prelude to the more detailed description presented below.

In one embodiment, a crutch has a main body having a substantially vertical tubular member with a plurality of apertures formed therein; an angled portion extending upwardly from the substantially vertical tubular member; an arm rest support extending perpendicularly from the angled portion for receiving an arm rest; and a handle extending outwardly from the arm rest support. The crutch further includes a leg telescopically received into the substantially vertical tubular member, and a foot exchangably received by the leg.

In another embodiment, a crutch includes a main body having a tubular member and an arm rest extending outwardly from the tubular member, and a leg telescopically received by the tubular member, the leg having a foot removably secured thereto. The arm rest has a cradle configured to receive the forearm of a user.

In still another embodiment, a crutch has a main body with a tubular member having a first and second end; an angled portion extending upwardly from the tubular member first end, the angled portion having a hollowed back to form a pocket therein; an arm rest support extending outwardly from the angled portion; and a handle extending outwardly from the arm rest support. A leg is telescopically received at a first end by the tubular member second end; and a foot is removably received by a second end of the leg.

DETAILED DESCRIPTION

Figure 1:
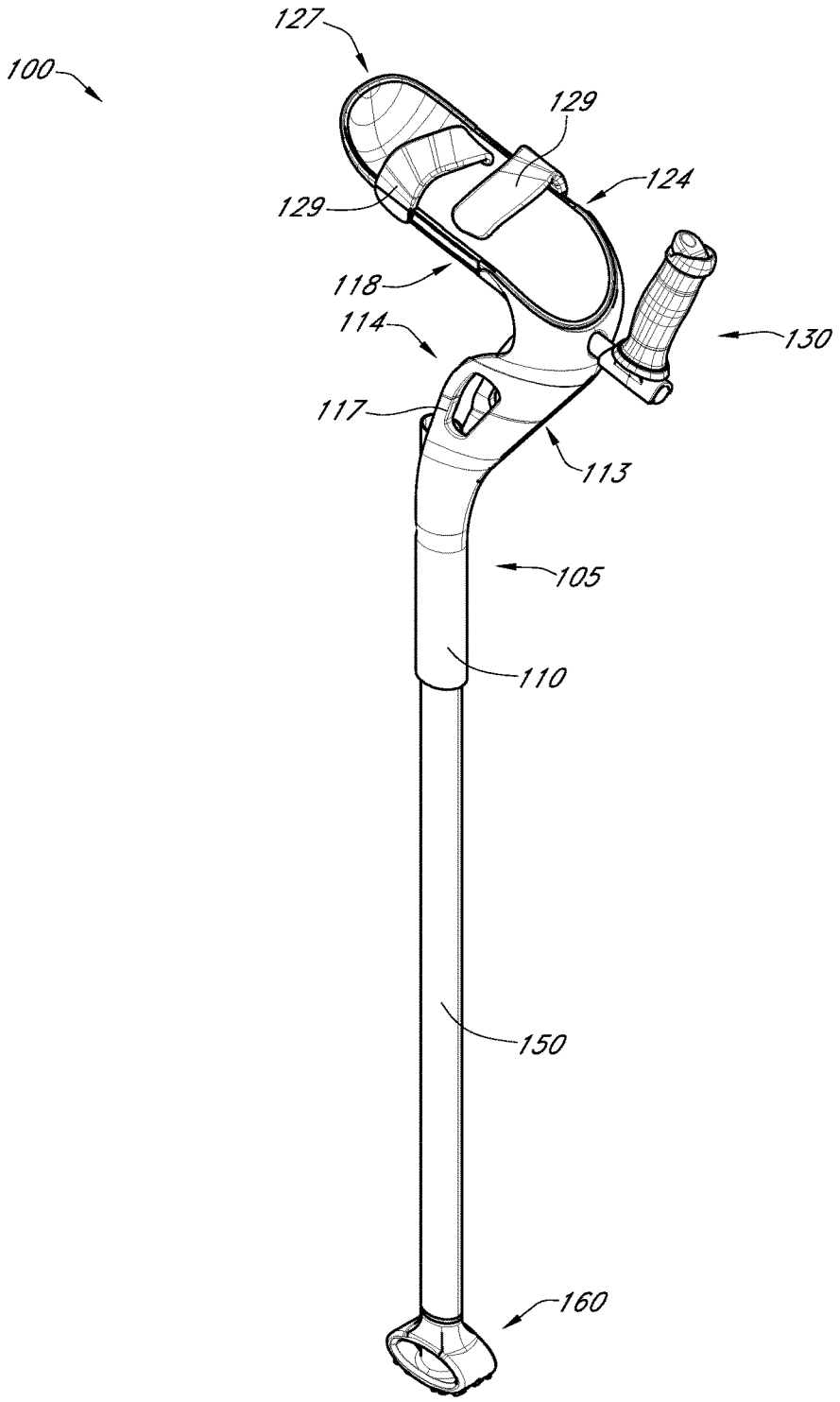
FIG. 1 is a perspective view of a crutch according to one embodiment of the invention.

Embodiments of crutches are disclosed herein. In one embodiment, illustrated by FIGS. 1-6, a crutch 100 has a main body structure 105 and a leg 150 attached to an interchangeable foot 160 for contacting the ground. The main body 105 may include a substantially vertical tubular member 110 leading to a first angled portion 113 which extends upwardly at an angle to a second oppositely angled portion 115 leading to an arm rest support 118 having a handle 140 extending therefrom.

Figure 4:
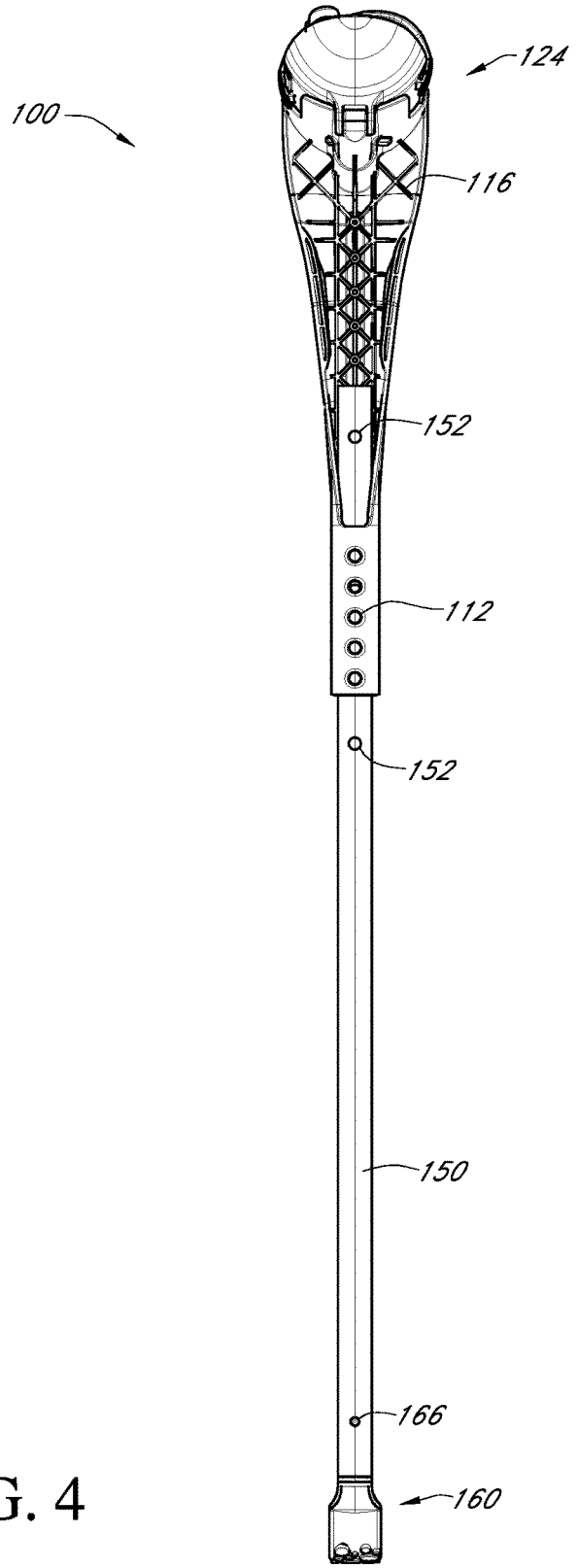
FIG. 4 is a rear view of the crutch according to the embodiment of FIG. 1.
Figure 5:
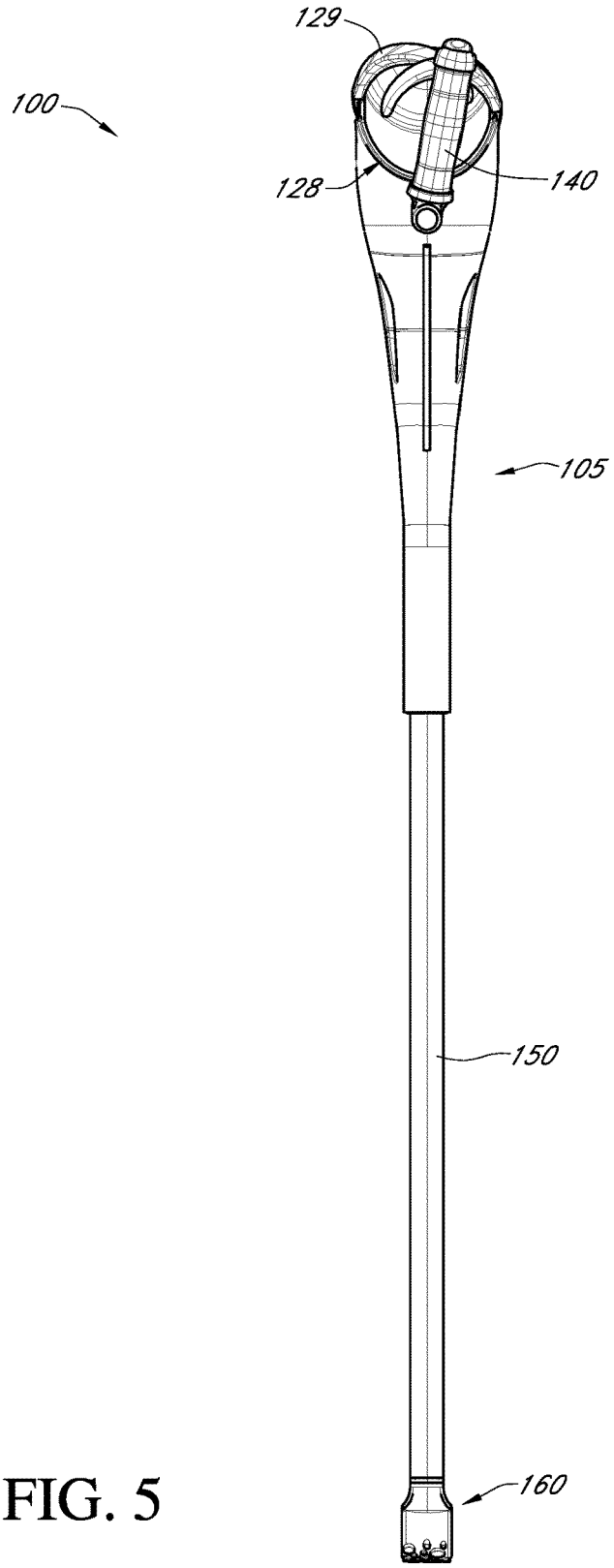
FIG. 5 is a front view of the crutch according to the embodiment of FIG. 1.
Figure 6:
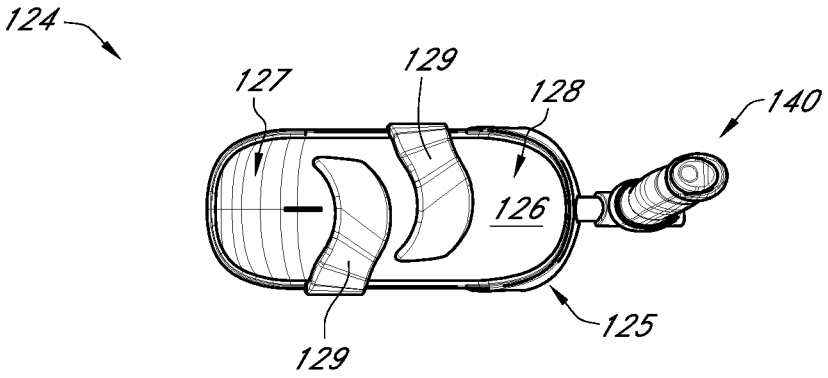
FIG. 6 is a top view of the crutch according to the embodiment of FIG. 1.

Referring to FIGS. 1 and 4, the main body vertical tubular member 110 may be hollow in order to receive the leg 150. As is described in greater detail below, the leg 150 may be equipped with a mechanical fastening mechanism, such as a quick release button, which may engage with apertures 112 formed in a backside of the vertical tubular member 110.

The vertical tubular member 110 extends upwardly toward the first angled portion 113, which extends upwardly in a forward direction at a predetermined angle between 0 and 90 degrees relative to horizontal. The first angled portion 113 may also be hollowed, forming a pocket 114 therein. The pocket 114 may be used, for example, as a pocket for storing a user's valuables, such as a keys or a cell phone, or may be equipped to hold other personal items such as a water bottle. To prevent the contents of the pocket 114 from slipping, and to minimize movement within the pocket 114, the pocket 114 may be equipped with a rubber (or other similar material) coating. Additionally, handles 117 may be formed into the sides of the angled portion 113 for ease of carrying the crutch 113.

The first angled portion 113 is so designed in order to provide the crutch 100 with shock absorbing capabilities. As the user relies on the crutch 100 and a portion of the user's body weight is transferred to the crutch 100, and the angled portion 113 is allowed to flex slights such that the angled portion 113 absorbs a portion of the force, transferring the transferred force away from the user's arms, hands, and/or under arms. Ribs 116, illustrated in FIG. 4, may be formed or placed around the interior surface of the angled portion 113 to provide reinforcement to the angled portion 113 and strength to the main body 105. Although not shown in the drawings, covers may be provided to snap (or otherwise attach) to the main body 105 to cover the ribs 116.

Figure 2:
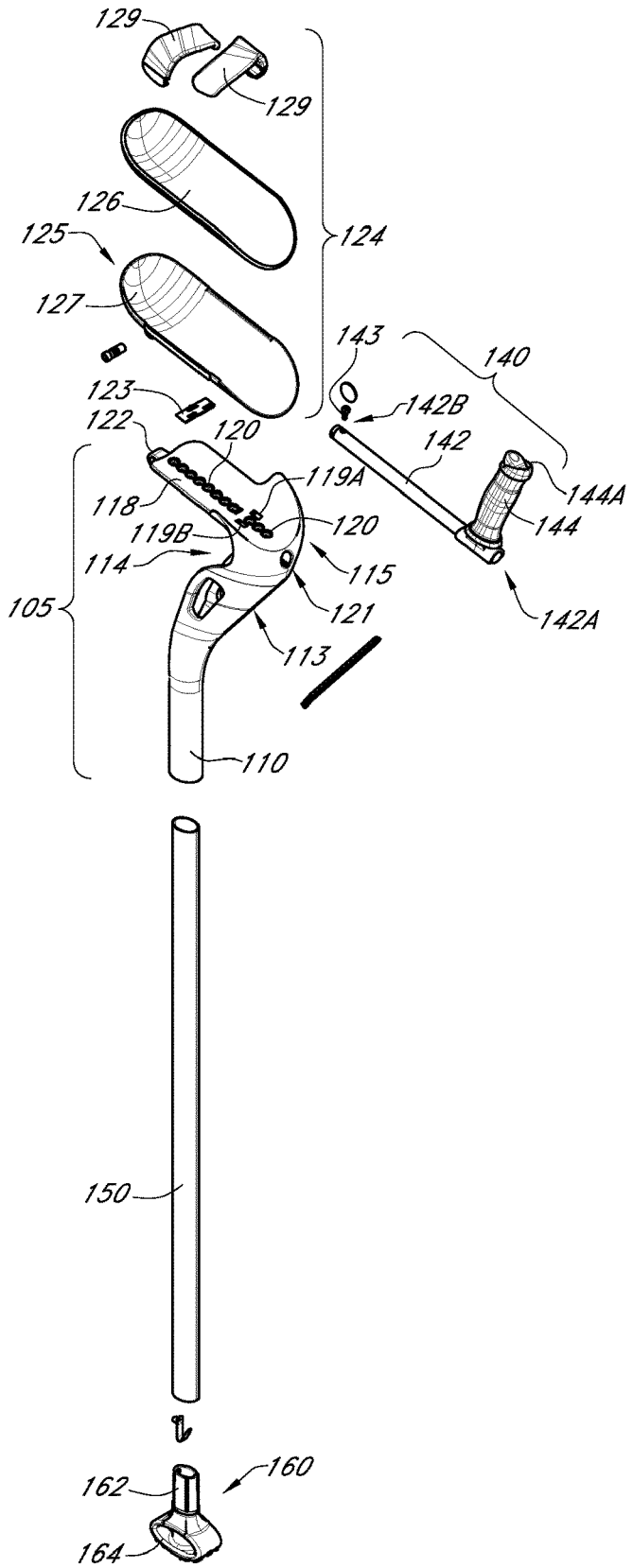
FIG. 2 is an exploded perspective view of the crutch according to the embodiment of FIG. 1.
Figure 3:
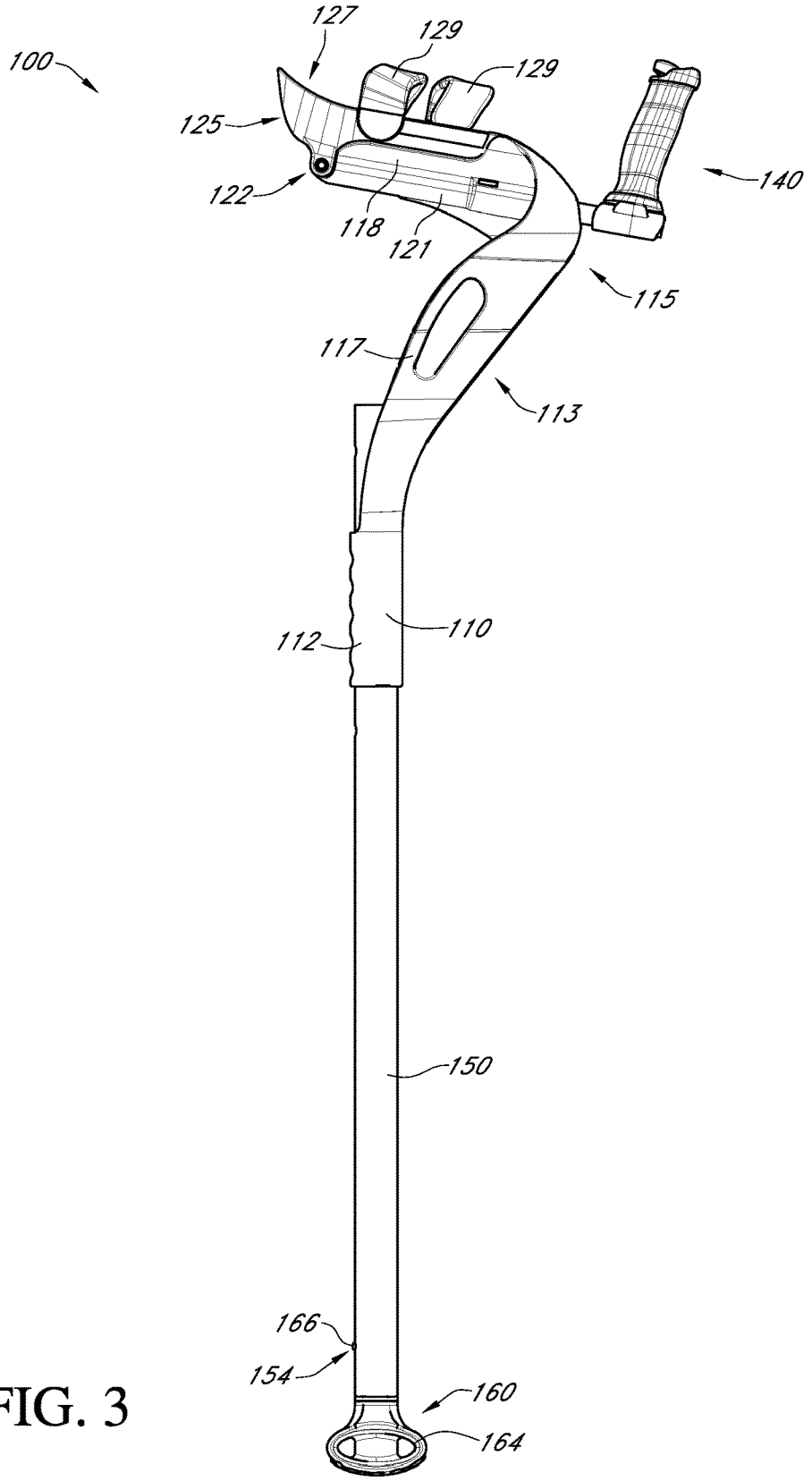
FIG. 3 is a side view of the crutch according to the embodiment of FIG. 1.

Moving on, and as described above, the first angled portion 113 extends upwardly to the second angled portion 115, which extends outwardly therefrom to form the arm rest support 118. As illustrated in FIGS. 2-3, the arm rest support 118 may be configured to engage with an arm rest 124. The arm rest 124 may include a cradle 125 configured to receive the user's forearm. Accordingly, the cradle 125 may include a first end comprising an elbow cup 127 for receiving the user's elbow, and a second open end 128 opposite the elbow cup 127, allowing the user's arm to extend outwardly therefrom. As described in greater detail below, bracing 129 may be provided and secured at positions along the outer edges of the cradle 125.

Figure 3A:
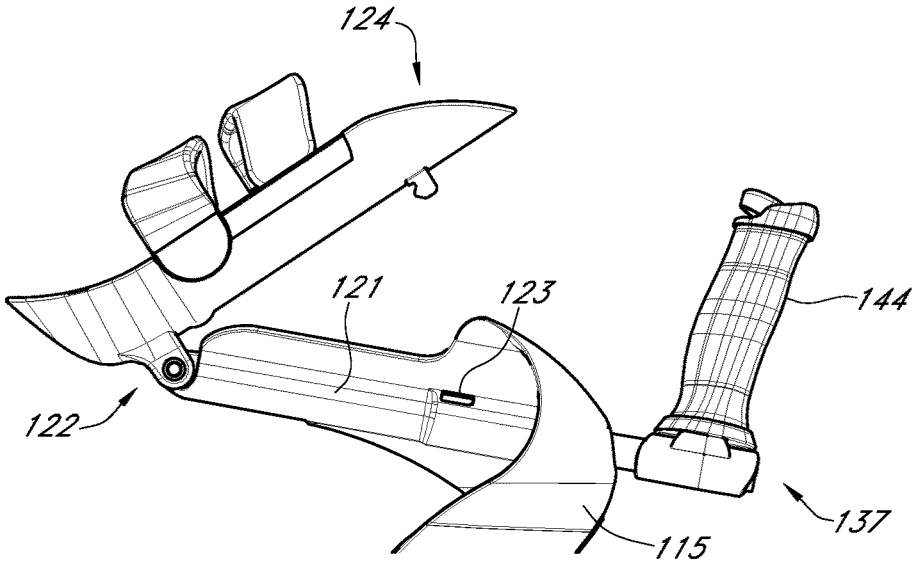
FIG. 3A is a side view of the crutch showing the arm rest cradle in an open position.
Figure 3B:
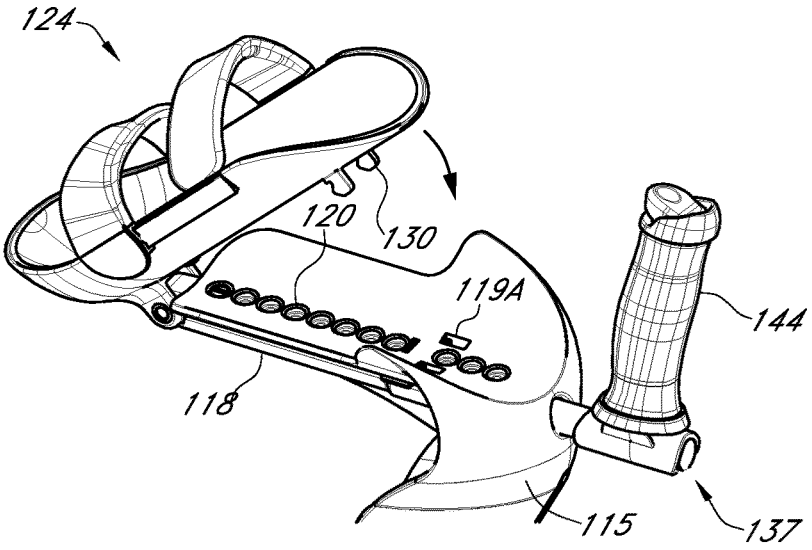
FIG. 3B is a top perspective view of the crutch of FIG. 3A.

Referring now to FIGS. 3, 3A, and 3B, in one embodiment, the cradle 125 may be hingedly connected to the arm rest support 118 via hinged connection 122. The cradle 125 may pivot about the hinged connection 122 as shown in FIGS. 3A and 3B. Teeth 130 may be provided along an underside of the cradle 125, which may engage with apertures 119A, 119B formed into the arm rest support 118. The cradle 125 may be secured to the arm rest support 118 via a sliding lock 123, for example, to prevent the cradle 125 from unexpectedly or undesirably detaching from the arm rest support 118.

In one embodiment, the arm rest support 118 may be held at a fixed position approximately 0 to 15 degrees relative to horizontal. Accordingly, the arm rest 124 may also be held at a position approximately 0 to 15 degrees relative to horizontal.

Padding 126, such as a foam insert, may be provided in the cradle 125 to provide maximum comfort and impact absorption. Foams of varying densities may be used depending on the user's specific requirements and comfort. Moreover, multiple layers of foam and/or other padding may be used to pad the cradle 125. It may be desirable for the padding 126 to be hydrophobic and/or antimicrobial to resist sweat and microbial growth. Fabric may additionally be provided for comfort. The elbow cup 127 may further include a gel pocket, either separately or embedded in the foam liner in order to provide extra padding, as the elbow cup 127 may receive the majority of the user's weight. In one embodiment, the padding 126 may be constructed of a first layer of single density foam, a gel pocket encapsulated at the area of the elbow cup 127, and a second layer of antimicrobial fabric.

The padding 126 may be removable such that the user can switch out the liners. Accordingly, the padding 126 may be secured to the cradle 125 via an adhesive (e.g., double sided tape, Velcro, etc.) or a mechanical attachment (e.g., snaps, hooks, etc.). Those of skill in the art will recognize that it may be beneficial for the padding 126 to have perforations to promote airflow.

Optionally, an upper arm sleeve may be attached to the back of the elbow cradle 125. The upper arm sleeve may provide stability to the crutch 100 when in use. The upper arm sleeve may be allowed to flex in order to support the user's upper arm to still permit natural movement of the user's arm. In one embodiment, the upper arm sleeve may include first and second arms, positioned on either side of the elbow cradle 125, and attached thereto with a spring loaded hinge or other appropriate mechanical fastening mechanism. A band may be secured to the free ends of the arms, and may be configured to wrap partially or completely around the user's upper arm. The spring loaded hinge may bias the upper arm sleeve in the direction of the user's arms. In use, the user's arms may overcome the force of the spring to bias the upper arm sleeve in the opposite direction. Accordingly, the upper arm sleeve may be configured to maintain constant contact with the user's upper arms.

The arm rest 124 may further be equipped with bracing 129 to maintain the user's arms in the cradle 125. The bracing 129 may include straps secured at one end to respective positions along either side of the cradle 125, the other end extending at least partially over the cradle 125. To allow for personalized positioning of the bracing 129, apertures (such as those shown in FIG. 8 at 331) may be formed along either or both sides of the length of the cradle 125 to serve as the connection point for the bracing 139. Various fastening mechanisms may be employed on one end of the straps to secure the bracing 129 to the cradle 125, such as snaps, rivets, screws, etc. Alternately, a t-bar slot may be formed along the outer edge of the cradle 125, and the straps may be equipped with a respective t-bar to engage with the t-bar slot. Those of ordinary skill in the art may recognize that the t-bar slot/t-bar fastening mechanism may allow the user the most flexibility in choosing the best position for the bracing 129.

The bracing 129 may be configured to restrain the user's arm while in normal use with the crutch 100, but to allow for a quick release of the user's arm when necessary. Accordingly, the bracing 129 may be constructed of a flexible plastic, or other flexible material. One exemplary material is ethylene vinyl acetate (EVA), which can be easily molded according to the size and shape of the user's arm. To mold EVA bracing 129, the user may place the individual straps into boiling water to make the EVA malleable. Then, the straps may be bent to the desired shape.

In another embodiment, the device may additionally, or alternately, utilize Velcro or other similar straps to secure the user's arms in the cradle 125. Other exemplary bracing mechanisms may include the use of rigid (e.g., hard plastic) straps in a hinged connection with the cradle 125, such as those shown in FIGS. 3A and 3B. Respective rigid straps may be located opposite each other on either side of the cradle 125, or on a single side of the cradle 125, and extend partially over the cradle 125. A gap may be provided between rigid straps extending from either side of the cradle 125 to allow the user to break free of the straps.

Those of skill in the art may recognize that the apertures (e.g., 331) formed in the cradle 125 may provide additional or alternative benefits to the user. For example, specially designed hooks, clips, trays, containers, or other accessories may be attached to the crutch 100, allowing the user to carry objects that he or she would otherwise not be able to carry, such as a purse or bag, grocery basket, food tray, pot of water, laundry basket, beverage, phone, etc.

Moving on, as briefly described above, the handle 140 extends outwardly from the arm rest support 118. The handle 140 may include an extension member 142 a gripping portion 144. The extension member 142 may be, for example, a telescoping rod having a proximal end 142B configured to engage with a channel 121 formed in the underside of the arm rest support 118, and a distal end 142A. To provide the most comfortable and natural fit, it may be beneficial for the channel 121 to be offset from the center of the arm rest support 118 by approximately 0 to 25 degrees. To customize the length of the extension member 142, the extension member 142 may be equipped with one or more quick release buttons (or other appropriate locking device) for engaging with respective openings 120 (FIGS. 2 and 3B) which may be formed along a length of the arm rest support 118 corresponding to the channel 121. To position the extension member 142, the user (or a person aiding the user) may disengage the locking device from the opening 120 in the channel 121. The extension member 142 may then be moved in the desired direction until the locking device on the extension member 142 engages with the desired opening 120. This process may be repeated until the handle 140 is at the desired distance.

Alternatively, the gripping portion 144 may be equipped with a length adjustment mechanism (e.g., button 144A) that releases the extension member 142 from its engagement with the channel 121 in order to move the extension member 142 to the desired position. In one embodiment, the button may be connected to a cable mechanism that may engage an element connected to a locking pin to move the handle 140 to the correct position for the user.

The gripping portion 144 may be secured to, and extend perpendicularly from, the extension member distal end 142A at an angle between approximately 0 and 15 degrees relative to vertical. In one embodiment, the gripping portion 144 may be secured to the extension member 142 via a bracket. In another embodiment, the gripping portion 144 may be secured via one or more hinges 137 or ball joint (e.g., FIG. 3A) for maximum rotation. The handle 140 may be configured to tilt along the x-z plane (e.g., toward and away from the user) and rotate about the y-z plane (e.g, left and right of the user). A button (e.g., button 144A) may be provided on the handle gripping portion 144 to release the hold of the gripping portion 144 on the extension member 142. Thus, to rotate the gripping portion 144 about the extension member 142, for example, the user may press the button 144A and move the gripping portion 144 to the desired position.

Additional embodiments of the handle 140 may alternately be realized to provide additional or alternative benefits to the user. Various mechanisms may lock the handle 140 in the desired position. In one embodiment, the grip 144 may and extension member 142 may be equipped with respective threading. To move the grip 144, the grip 144 may be "unscrewed" and rotated into the desired position, and then rotated in the opposite direction to lock the grip 144 in place.

Referring now to FIG. 4, the leg 150 telescopically engages with the substantially vertical tubular member 110 of the main body 105. Accordingly, the leg 150 may be equipped with one or more quick release connectors 152 (or other appropriate fastening mechanism) which may interact with corresponding apertures 112 formed in the substantially vertical tubular member 110. The quick release connectors 152 may be provided at various positions along the leg 150 (e.g., at the top of the leg 150, near the middle of the leg 150, etc., as shown in FIG. 4) to allow for maximum height adjustment.

To change the position of the leg 150, the quick release connector 152 may be pressed in by the user (or the person aiding the user) and the leg 150 moved in and out of the tubular member 110 until the desired height is reached. For transporting purposes, it may be desirable for the leg 150 to be inserted as far as possible into the tubular member 110 to minimize the footprint of the crutch 100.

As shown in the figures, the foot 160 may extend from the leg 150 and may be configured to provide a means for efficiently and comfortably contacting the ground. Typically, a person's foot moves in a heel-to-toe manner when walking. However, prior art crutches often come with a rubber end that is perfectly flat. While the rubber allows for some flexibility to move with the person, the natural tendency of the foot is to be completely flat on the ground.

Figure 9:
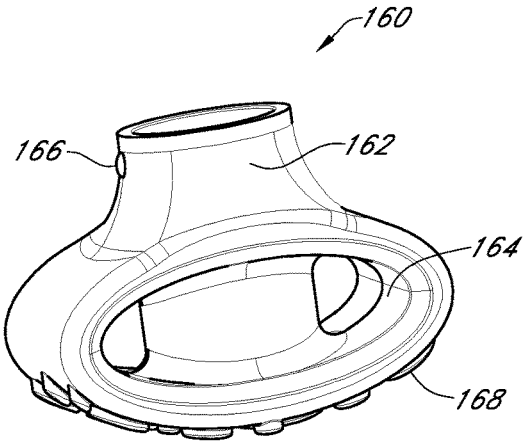
FIG. 9 is a close up perspective view of a foot according to an embodiment of the invention.

In one embodiment, illustrated in FIG. 9, the foot 160 may include a neck 162 having at least one mechanical fastener (such as a quick release connector 166) formed thereon, and a hollowed annular member 164 extending downwardly from the neck 162. The neck 162 of the foot 160 may be received into the end of the leg 150 such that the mechanical fastener 166 engages with an aperture 154 formed in the leg 150 to secure the foot 160 thereto. Therefore, it shall be understood that the foot 160 may be interchangeable.

The foot 160 may be formed of flexible plastic, such as acrylonitrile butadiene styrene (ABS), which may allow for slight compression of the annular member 164 of the foot 160 as forced is placed on the crutch 100, thereby providing additional shock-absorption benefits. Different strength materials may alternatively be utilized in order to accommodate a range of weights. Due to the annular nature of the foot 160, the crutch 100 may move in a more natural way across the ground, as the foot 160 may be able to emulate the movement of a human's foot as it travels across the ground.

The hollowed annular member 164 may be covered with treading 168 for gripping. Since the foot 160 may be interchangeable due to the ability to remove the foot 160 from the end of the leg 150, various feet may be provided, each being configured for a specific situation. For example, there are different tread styles that are beneficial depending on the weather. Therefore, one interchangeable foot 50 may be equipped with a tread design suitable for everyday use. Other interchangeable feet 50 may be for indoor use, use in the rain, ice and/or snow. Additionally, other types or shapes of feet may also be desirable. For example, there may be situations in which an off-the-shelf crutch foot may be desirable. Furthermore, carbon-fiber feet may be desirable where the user wishes to use the crutches 100 in an athletic manner. Still further types of feet that may be incorporated onto the crutch 100 include a tripod or a quad foot which may increase the stability of the crutch 100.

In another embodiment, to provide further traction, an opening may be formed in the bottom rim of the hollowed annular member 164, and the top rim of the hollowed annular member 164 may be equipped with a pin. As the user walks, the force of the user's weight on crutch 100 may cause the foot 160 to compress slightly, causing the pin to protrude through the opening, and into the ground. It may be understood that a foot 160 having a pin would not be desirable on hard surfaces, such as concrete or asphalt.

In one embodiment, the foot 160 may be equipped with a cover that slides into place over the foot 160 upon activation of a trigger. The trigger may be located, for example, on the handle 140 of the crutch 100, and the user may activate the trigger, causing the cover to move into place over the foot 160. The trigger may then be pushed again to move the cover off the foot 160, or to separate the cover from the foot 160 entirely.

Figure 7:
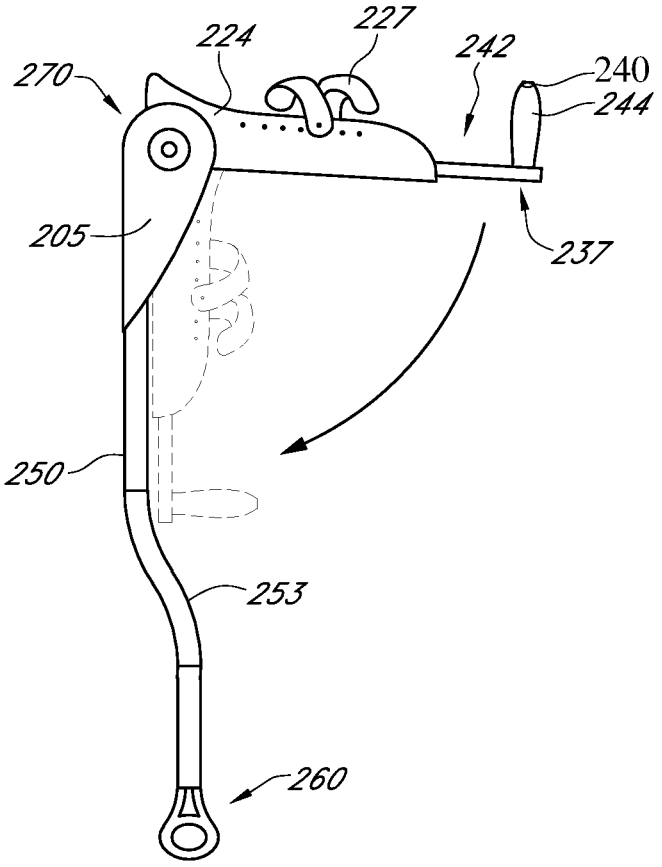
FIG. 7 is a side view of a crutch according to another embodiment of the invention.

FIG. 7 illustrates another embodiment of a crutch 200 which is substantially similar to embodiment 100 except as shown and/or described herein, or as would be inherent. Further, those skilled in the art will appreciate that the embodiment 100 (and thus embodiment 200) may be modified in various ways, such as through incorporating all or part of any of the various described embodiments, for example. For uniformity and brevity, reference numbers between 200 and 299 may be used to indicate parts corresponding to those discussed above numbered between 100 and 199, though with any noted or described deviations.

In embodiment 200, the arm rest 224 may be pivotally connected to the main body 205 and/or the leg 250 via a hinged connection 270. The arm rest 224 may thus be rotatable from about 0 to 135 degrees relative to horizontal, as illustrated. To accommodate the degrees of rotation of the arm rest 224, the main body 205 may be modified such that an opening is formed therein to receive the arm rest 224. Further, the leg 250, may include an angled portion 253, as shown, to provide shock absorbing benefits to the crutch 200. Accordingly, the leg 250 may be formed from any material sufficient to allow the leg 250 to slightly flex and subsequently return to its original position.

The crutch 200 may be configured such that a button, for example, on the handle 240, allows the user to easily change the position of the arm rest 224. This may be particularly useful when the user is, for example, ascending or descending stairs.

Figure 8:
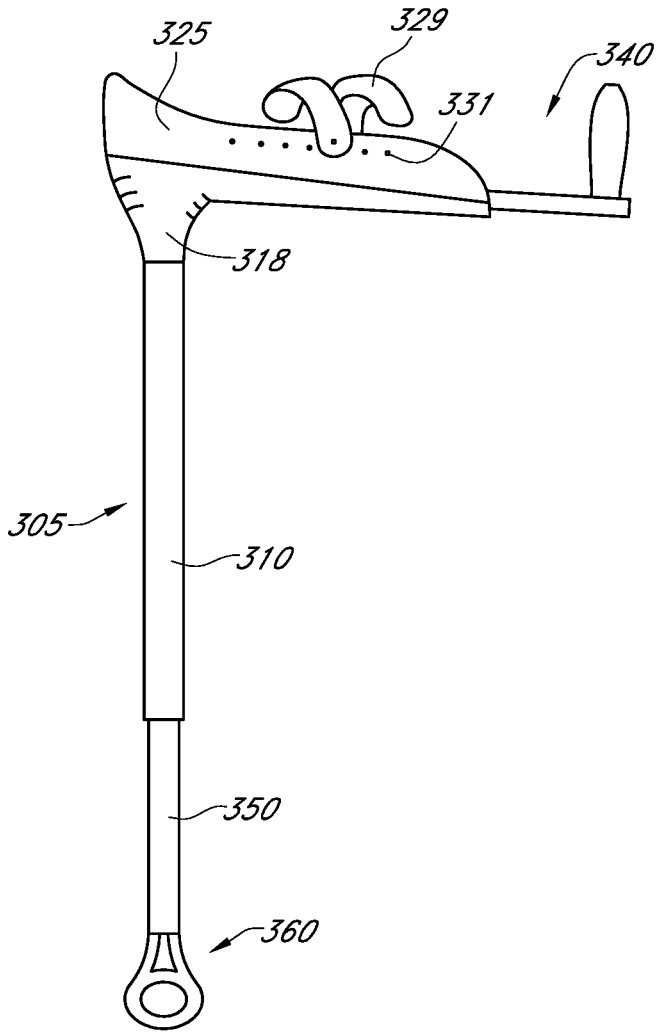
FIG. 8 is a side view of a crutch according to still another embodiment of the invention.

FIG. 8 illustrates another embodiment of a crutch 300 which is substantially similar to embodiment 100 except as shown and/or described herein, or as would be inherent. Further, those skilled in the art will appreciate that the embodiment 100 (and thus embodiment 300) may be modified in various ways, such as through incorporating all or part of any of the various described embodiments, for example. For uniformity and brevity, reference numbers between 300 and 399 may be used to indicate parts corresponding to those discussed above numbered between 100 and 199, though with any noted or described deviations.

In embodiment 300, the leg 350 may be a single straight leg tube. The main body 305 may include a single substantially vertical tubular member 310 for interacting with the leg 350, and an arm rest support 318. The arm rest support 318 may be fixed to the substantially vertical tubular member 310 at an angle of between approximately 0 to 15 degrees relative to horizontal. A cradle 325 may be received into the arm rest support 325, and a handle 340 may extend from the arm rest support 318 as described above.

Figure 10:
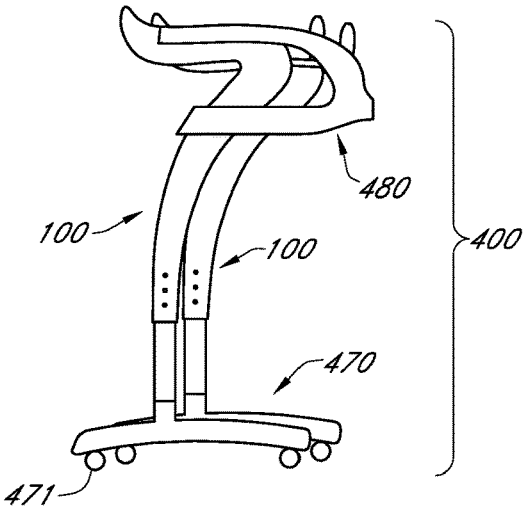
FIG. 10 is a perspective view of two crutches secured together to form a walker according to an embodiment of the invention.
Figure 11:
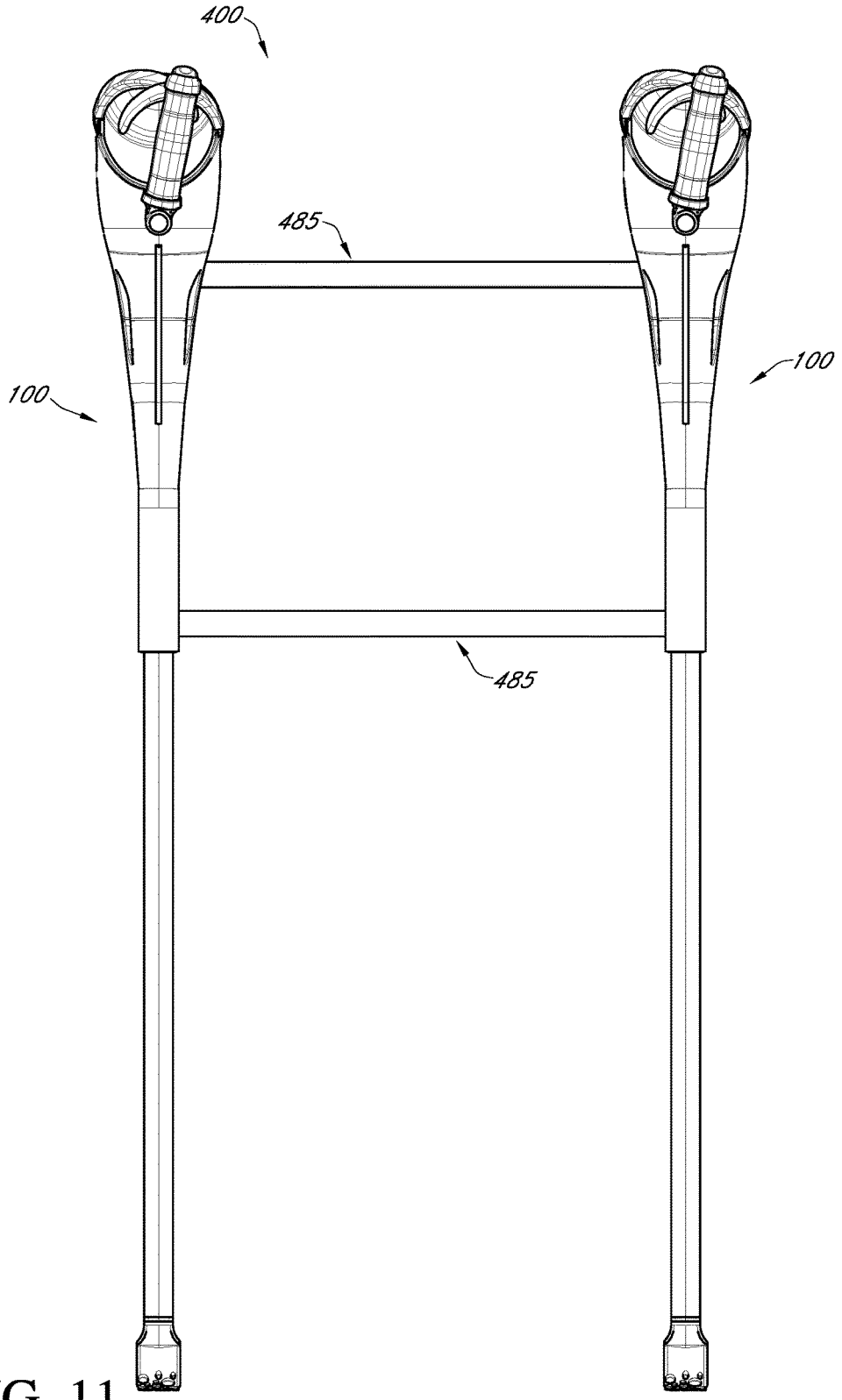
FIG. 11 is a front view of the embodiment of FIG. 10.

FIGS. 10 and 11 illustrate another embodiment 400, comprising two or more crutches as described herein to form a walker. For ease of reference, the walker 400 is described with reference to the use of crutches according to the embodiment 100. However, it shall be understood that any of the crutches 100, 200, 300 described herein may alternately, or additional be incorporated into embodiment 400 as appropriate.

In embodiment 400, two crutches 100 may be fastened together to form a walker 400. Here, the crutches 100 may be attached together via a bracket 480 (FIG. 10). The bracket 480 may be secured to each of the respective crutches 100 with a mechanical fastener, such as a screw. Alternately, each individual crutch 100 may be equipped with means for receiving an end of a structural rod member 485. The crutches 100 may be placed in parallel positions, and the structural rod member 485 may be received by the crutches 100 and secured in position to form the walker 400. To provide stability, the feet 470 of the crutches 100 may be elongated. In another embodiment of the walker 400, not shown, the walker 400 may include four crutches 100, secured together via brackets 480 and/or structural rod members 485 in an open square configuration. Small casters 471 may additionally be placed in the corners (e.g., at the ends of the elongated feet, at each foot, etc.) for increased maneuverability.

Various additional devices may also be incorporated into each crutch 100, 200, 300, and 400. For example, a pedometer may be housed inside the device (for example, in the main body 105) to track activity levels. The pedometer may be in wireless communication with, for example, a smart phone or other tracking device. Other electronic modules or multipurpose modulus may be included to measure and provide information on other physiological parameters, such as blood-pressure and heart-rate monitors, as well as means for tracking number of calories burned. Still additional metrics that may be tracked include speed, points of stress, number of minutes the crutch is used per day, et cetera. The data may be relevant for developing tools for managing the user's health and for maximizing the life of the crutch.

Further, each crutch 100 may be equipped with a means for snapping, locking, or otherwise attaching pairs of crutches 100 together for ease of carrying the crutches 100. In one embodiment, magnets may be provided in the main body 105 of each crutch 100 such that, when positioned together, the crutches 100 stick together. In another embodiment, a first crutch 100 may be equipped with a hook, and a second crutch 100 equipped with means for engaging with the hooks, such that the crutches 100 may be attached for easy transportation. Other attachment means may additionally, or alternately, be appropriate for connecting individual crutches together.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention. Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

What is claimed is:

1. A crutch, comprising:

a main body, comprising:

a first section forming a substantially vertical tubular member having a plurality of apertures formed therein;

a second section forming an angled portion extending upwardly from the substantially vertical tubular member; and a third section forming an arm rest support having a proximal end and a distal end, the proximal end extending perpendicularly away from the angled portion and configured to receive an arm rest;

wherein the first, second, and third sections are integrally formed of a single piece of material;

a handle received into and extending outwardly from an opening formed in the arm rest support;

a leg telescopically received into the substantially vertical tubular member; and a foot exchangably received by the leg.

2. The crutch of claim 1, wherein the arm rest comprises a cradle having a first end comprising an elbow cup and an opposing open second end.

3. The crutch of claim 2, wherein the arm rest further comprises a brace, the brace being secured to an outside edge of the cradle and extending partially over the cradle.

4. The crutch of claim 2, wherein the arm rest is hingedly connected to the arm rest support, and wherein teeth formed on a bottom side of the arm rest engage with corresponding apertures defined in the arm rest support.

5. The crutch of claim 2, wherein the cradle is covered with padding.

6. The crutch of claim 1, wherein the arm rest support is fixed at an angle approximately 0 to 15 degrees relative to horizontal.

7. The crutch of claim 1, wherein the handle comprises an extension member having a distal end and a proximal end, and a gripping portion secured to the extension member distal end, the gripping portion being rotatable about the extension member distal end; and wherein the extension member proximal end is received into a channel formed in a bottom side of the arm rest support.

8. The crutch of claim 7, wherein the extension member proximal end includes a mechanical fastener, the mechanical fastener respectively engaging with one of a plurality of openings formed in the arm rest support channel.

9. The crutch of claim 1, wherein the foot comprises a neck received by the leg, and an annular member having a hollow center and an outer surface at least partially covered by treading.

10. The crutch of claim 1, wherein the handle is offset from a center of the arm rest support by approximately 0 to 25 degrees.

11. The crutch of claim 1, wherein the foot comprises a releasable locking mechanism which engages with an aperture formed in a lower portion of the leg.

12. A crutch system, comprising:

a first crutch, comprising:

a main body forming a tubular member and an arm rest support extending outwardly from the tubular member, the main body being formed from a single piece of material;

an arm rest hingedly connected to the arm rest support; and a leg telescopically received by the tubular member, the leg having a foot removably secured thereto;

wherein the arm rest support forms a cradle configured to receive the forearm of a user.

13. The crutch of claim 12, wherein the arm rest support further comprises a brace having a fastening mechanism secured to one end, the fastening mechanism engaging with one of a plurality of apertures formed along the length of an outside edge of the arm rest support.

14. The crutch of claim 12, further comprising a handle received into and extending outwardly from an opening formed in the arm rest.

15. The crutch of claim 12, wherein the arm rest support is fixed to the tubular member at an angle of approximately 5 to 15 degrees relative to horizontal.

16. The crutch of claim 12, wherein the leg is substantially vertical.

17. The crutch system of claim 12, further comprising a second crutch, wherein the first and second crutches are detachably secured together via a structural rod or brace to form a connected crutch.

18. A crutch, comprising:

a main body, comprising:

a tubular member having a first and second end;

an angled portion extending upwardly from the tubular member first end, the angled portion having a hollowed back forming a pocket therein, the pocket being configured to hold one or more small items; and an arm rest support extending outwardly from the angled portion for receiving an arm rest, the arm rest being hingedly connected to the arm rest support;

a handle extending outwardly from the arm rest support;

a leg telescopically received at a first end by the tubular member second end; and a foot removably received by a second end of the leg.

* * * * *